US006573037B1

(12) United States Patent
Lobo et al.

(10) Patent No.: US 6,573,037 B1
(45) Date of Patent: Jun. 3, 2003

(54) IMAGING ELEMENT COMPRISING SOLUBILIZED COLLAGEN GELATIN AND HARDENER

(75) Inventors: Lloyd A. Lobo, Webster, NY (US); Hwei-Ling Yau, Rochester, NY (US); James S. Honan, Spencerport, NY (US); Paul T. Hahm, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/158,656

(22) Filed: May 30, 2002

(51) Int. Cl.[7] ..... G03C 1/047; G03C 1/30

(52) U.S. Cl. ..... 430/539; 430/621; 430/622; 430/642

(58) Field of Search ..... 430/642, 621, 430/622, 539

(56) References Cited

U.S. PATENT DOCUMENTS

| | | | | |
|---|---|---|---|---|
| 3,615,626 A | * 10/1971 | Doste et al. | 430/642 |
| 4,360,590 A | * 11/1982 | Tomka | 430/642 |
| 4,824,939 A | 4/1989 | Simpson | 530/356 |
| 5,236,822 A | 8/1993 | Riecke et al. | 430/621 |
| 5,731,134 A | 3/1998 | Honan et al. | 430/642 |
| 5,908,921 A | 6/1999 | LaRoche et al. | 530/354 |
| 5,919,906 A | 7/1999 | Rowlands et al. | 530/354 |
| 5,958,660 A | 9/1999 | Taylor et al. | 430/621 |
| 5,962,210 A | 10/1999 | Hahm et al. | |
| 6,080,843 A | 6/2000 | Rainville et al. | 530/355 |
| 6,100,381 A | 8/2000 | Rowlands et al. | 530/355 |
| 6,316,174 B1 | 11/2001 | Sawyer et al. | 430/496 |

FOREIGN PATENT DOCUMENTS

EP 0 971 262 A1 1/2000

OTHER PUBLICATIONS

Andrew M. Howe, Andrew Clarke, and Thomas H. Whitesides; "Viscosity Of Emulsions Of Polydisperse Droplets With A Thick Adsorbed Layer"; Langmuir; 1997; vol. 13; pp. 2617–2626.

Michael Dreja, Kurt Heine, Bernd Tieke and Gunter Junkers; "Effects Of Functionalized Latex Particles And Anionic Surfactants On The Flow Behavior Of Aqueous Gelatin Dispersions"; Journal Of Colloid And Interface Science; 1997; vol. 191; pp. 131–140.

K. Abraham Vaynberg, Norman J. Wagner, Ravi Sharma, and Peter Martic; "Structure And Extent Of Adsorbed Gelatin On Acrylic Latex And Polystyrene Colloidal Particles"; Journal Of Colloid And Interface Science; 1998; vol. 205; pp. 131–140.

K. Abraham Vaynberg and Norman J. Wagner; "Rheology Of Polyampholyte (Gelatin)–Stabilized Colloidal Dispersions: The Tertiary Electroviscous Effect"; Journal Rheology; 2001; vol. 45; pp. 451–466.

John H.E. Hone, Andrew M. Howe, and Thomas H. Whitesides; "Rheology Of Polystyrene Latexes With Adsorbe And Free Gelatin"; Colloids And Surfaces A: Physicochemical And Engineering Aspects; 2000; vol. 161; pp. 283–306.

U.S. patent application No. 10/158,681; filed May 30, 2002; of Andrew M. Howe, Lloyd A. Lobo, and Gary L. Santee; titled "Coating Fluid For Imaging Element Comprising Solubilized Collagen Gelatin And Hardener".

U.S. patent application No. 10/158,651; filed May 30, 2002; of Andrew M. Howe, Richard W. Connelly, James S. Honan and Lloyd A. Lobo; titled "Coating Fluid For Imaging Element Comprising Solubilized Collagen Gelatin And Colloidal Dispersion".

U.S. patent application No. 09/621,267; filed Jul. 21, 2000; of Tamara K. Jones, Lloyd A. Lobo, Mridula Nair, Kevin M. O'Connor, Tiecheng A. Qiao, Yongcai Wang, Thomas H. Whitesides, and Hwei–Ling Yau; titled "Protective Overcoat For Photographic Elements".

* cited by examiner

*Primary Examiner*—Richard L. Schilling
(74) *Attorney, Agent, or Firm*—Andrew J. Anderson

(57) ABSTRACT

An imaging element is described comprising one or more hydrophilic colloid layers which include gelatin as a film forming binder which has been chemically crosslinked with a gelatin hardener, wherein at least 20% of the gelatin of at least one of the one or more hydrophilic colloid layers comprises a gelatin prepared from hydrolysis of ossein using sodium or potassium hydroxide, and the gelatin is chemical crosslinked with a gelatin hardener at a level from 70 to 120 effective $\mu$mole hardener per gram of gelatin. Improvements are obtained in the wet mechanical strength of an imaging element comprising gelatin as a binder, without needing to increase the amount of chemical crosslinker with respect to the gelatin. The invention further enables the use of relatively low molecular weight gelatins without compromising the wet mechanical strength of imaging elements and without needing to increase the amount of crosslinker relative to the amount of gelatin. The invention also enables the selective improvement in the wet mechanical properties of layers with a high ratio of non-binder materials to binder without substantially increasing the amount of chemical crosslinker.

16 Claims, No Drawings

IMAGING ELEMENT COMPRISING SOLUBILIZED COLLAGEN GELATIN AND HARDENER

FIELD OF THE INVENTION

This invention relates to imaging elements comprising a hydrophilic colloid gelatin, which is prepared by the hydrolysis of ossein using sodium or potassium hydroxide, where the gelatin is crosslinked with a hardener at a level of 70–120 effective $\mu$mole hardener per gram of gelatin.

BACKGROUND OF THE INVENTION

Imaging elements, particularly photographic silver halide imaging elements, commonly use a hydrophilic colloid as a film forming binder for layers thereof, most commonly ossein. The layers of such imaging elements are typically coated employing multilayer slide bead coating processes such as described in U.S. Pat. No. 2,716,419 and multilayer slide curtain coating processes such as described in U.S. Pat. No. 3,508,947. The binder of choice in most cases is gelatin, prepared from various sources of collagen (see, e.g., P. I. Rose, The Theory of Photographic Process, 4th Edition, edited by T. H. James (Macmillan Publishing Company, New York, 1977) p. 51–65). The binder is expected to provide several functions, primarily to provide an element with some level of mechanical integrity and contain all the materials within the imaging element, which are required to provide an image. In particular, in photographic elements, the binder is expected to facilitate the diffusion of materials into and out of the element during a wet processing step. Gelatin is particularly suitable to perform this function, since it can absorb water and swell during the processing steps. In addition, gelatin also forms a cross linked network below a critical setting temperature through non-covalent bonding, which prevents dissolution of the gelatin, when wet. However, most photoprocessing operations are carried out above the critical temperature, which would thereby melt the gelatin in a non-crosslinked form. In order to prevent the dissolution of the gelatin during the photoprocessing operation, the gelatin is crosslinked chemically, with a hardener, during the manufacture of the imaging element.

High purity gelatins are generally required for imaging applications. Currently the most commonly employed manufacturing process for obtaining high purity gelatins involves demineralization of a collagen containing material, typically cattle bone (ossein), followed by extended alkaline treatment (liming) and finally gelatin extractions with water of increasing temperature as described in U.S. Pat. Nos. 3,514,518 and 4,824,939. The gelatin produced by this process, commonly referred to as lime processed ossein gelatin, has existed with various modifications throughout the gelatin industry for a number of years. The liming step of this process requires up to 60 days or more, the longest step in the approximately 3 month process of producing gelatin. The hydrolyzed collagen is extracted in a series of steps to obtain several gelatin fractions with varying molecular weights. In order to obtain gelatin of desired molecular weight to provide suitable coating solution viscosities, these fractions can be further hydrolyzed by high temperature hydrolysis. The fractions are then blended to obtain the appropriate molecular weight for photographic use. U.S. Pat. No. 5,908,921 describes a relatively new process for the preparation of photographic grade gelatin, where the agent for hydrolysis is a strong alkali, such as sodium or potassium hydroxide. The reaction rate is disclosed to be from 10 to 120 hours (substantially faster than the prior lime processes), after which a single extraction step yields a single batch of gelatin, which is then purified and deionized. The characteristics of the gelatin produced are that it has a high gel strength and narrow molecular weight distribution compared to gelatins produced by the conventional process where lime is used as the agent for hydrolysis.

Performance of the binder system may also be altered via chemical modification of the gelatin employed, as well as the choice and level of the hardener. Most of the hardeners used in practice act by reacting moieties on the hardener with the free amine groups on the gelatin. Lysine and hydroxylysine are the two predominant amino acids in gelatin that contribute the primary amine groups. Chemical modification of gelatin by increasing the amount of free amine groups have been disclosed in U.S. Pat. No. 5,316,902; U.S. Pat. No. 5,439,791 and EP 614930 and EP 813,109. These patents disclose elements wherein the carboxylic acid containing amino acids are reacted with moieties that can further react with vinyl sulfonyl hardeners. These are directed towards providing differential hardening between layers of a multilayer coating. Modified gelatin has also been disclosed in U.S. Pat. No. 4,590,151 for use in a top layer of a multilayer coating to reduce the amount of reticulation during photoprocessing. While chemical modification of gelatin may increase the wet mechanical properties of the imaging element, it is not easy or inexpensive to carry out. It adds an extra step in the gelatin manufacturing process and includes additional cost of the reactants needed. Other methods of improving the wet mechanical properties are by including other polymers along with gelatin. These polymers may be in the form of latexes as disclosed in U.S. Pat. No. 4,495,273 or as gelatin substitutes as disclosed in U.S. Pat. No. 4,019,908. Other attempts to improve the mechanical properties of the element, in the wet state, are related to improving the adhesion of the gelatin element to the substrate on which it is coated. EP 727698 discloses the use of specific solvents in layer adjacent to the support. However, even if the adhesion problems are solved, the cohesive strength or the wet strength property still may need to be improved.

Optimization of chemical hardening properties of a coated layer comprising gelatin is critical. While some attempts to optimize performance of the binder system have been carried out via chemical modification of the gelatin employed as discussed above, most attempts to optimize the binder system have focused on the choice and level of the hardener. It is the chemical hardening that renders the coating insoluble, and provides the required durability. The amount of hardener used, relative to the amount of gelatin present, is typically primarily a compromise of the swell of the wet element, the mechanical integrity, and cost. If too much hardener is used, the imaging element will not swell much, thereby, reducing the mobility of the various species required to permeate the element during processing. If too little hardener is used, however, when the element is in the developing solution, and immediately after removal from the developing solutions, it may be easily scratched while wet as the amount of chemical crosslinking is less and the coating becomes mushy, and prone to damage if it comes into contact with the hardware of the photoprocessor. Such scratches to the surface of the element may cause an unacceptable image to be formed. The third factor is cost of the hardener. It is always desirable to use less hardener.

Another factor which may impact the wet mechanical properties of imaging elements such as photographic elements is the amount of dispersed non-binder materials that are present in layers thereof, such as dispersed photographically useful materials. As the ratio of the amount of non-binder material, relative to the binder, increases, the mushiness of the element also increases. Thus, elements which have a higher volume fraction of non-binder material typically require a higher level of hardener relative to elements with a low ratio in order to provide comparable wet mechanical strength. In addition, most photographic elements are comprised of more than one layer. In a multilayer photographic element each of the layers may have a different ratio of the non-binder materials to the binder. The weakest link in this multilayer element is the one with the highest volume fraction of non-binder to binder material. Thus it may be desirable to be able to selectively strengthen the layers which have such high volume fractions.

It would be desirable to be able to increase the wet mechanical strength of gelatin coating without the need for increasing the amount of chemical crosslinker, and without the need for chemically modifying functional groups of the gelatin.

SUMMARY OF THE INVENTION

In accordance with the invention, an imaging element is described comprising one or more hydrophilic colloid layers which include gelatin as a film forming binder which has been chemically crosslinked with a gelatin hardener, wherein at least 20% of the gelatin of at least one of the one or more hydrophilic colloid layers comprises a gelatin prepared from hydrolysis of ossein using sodium or potassium hydroxide, and the gelatin is chemical crosslinked with a gelatin hardener at a level from 70 to 120 effective $\mu$mole hardener per gram of gelatin.

The present invention enables relative improvements in the wet mechanical strength of an imaging element comprising gelatin as a binder, without needing to increase the amount of chemical crosslinker with respect to the gelatin. The invention further enables the use of relatively low molecular weight gelatins without compromising the wet mechanical strength of imaging elements and without needing to increase the amount of crosslinker relative to the amount of gelatin. The invention also enables the selective improvement in the wet mechanical properties of layers with a high ratio of non-binder materials to binder without substantially increasing the amount of chemical crosslinker.

DETAILED DESCRIPTION OF THE INVENTION

High purity gelatins are required for imaging/photographic applications. One gelatin property of interest is absorbance at 420 nm (A420), commonly know as color. The lower the A420 of gelatin the clearer the gelatin layer is in coated products. The A420 of gelatin is one of the defining factors for determining applicability of the gelatin for imaging applications. Edible gelatins are typically higher than photographic gelatins in A420. Two other gelatin properties critical to imaging applications are viscosity and gel strength or Bloom. High gel strength is required for gelatin setting properties. Typical alkaline processed bone gelatins contain high gel strength and high viscosity. Viscosity can be controlled during the gelatin manufacturing process with heat treatment. Heat treatment reduces both gel strength and viscosity. Ideally, a gelatin with high gel strength and low viscosity would be advantageous to coated products, in that coating speeds could be increased with no loss in gelatin setting properties. Typical gel strengths are from 250 to 300 Bloom and typical viscosities are from 5 to 15 cP.

Due to variable bond breakage during manufacture, gelatin is composed of a distribution of polypeptides of varying molecular weights. Aqueous size exclusion chromotagraphy provides a method of analysis for determining the gelatin molecular weight distribution. This distribution is described as containing the following fractions; high molecular weight or HMW (>250 K daltons); Beta (250–150 K daltons); Alpha (150–50 K daltons); Subalpha (50–20 K daltons); and low molecular weight or LMW (20–4 K daltons). In general, high gel strength correlates with high gelatin alpha fraction content, and high viscosity correlates with high gelatin HMW fraction content.

At least 20% of the gelatin of at least one hydrophilic colloid layer of an imaging element in accordance with the invention comprises a gelatin prepared from a process comprising hydrolysis of ossein utilizing a caustic sodium or potassium hydroxide solution to produce gelatin from a collagen containing material, such as described in U.S. Pat. No. 5,908,921, the disclosure of which is incorporated by reference herein. The process for the manufacture of gelatin as taught in U.S. Pat. No. 5,908,921 includes providing a collagen containing material and demineralizing the collagen containing material to produce ossein which is homogenized or ground. The ossein is added to a water solution of sodium hydroxide or potassium hydroxide at a concentration of at least 4% by weight and a swelling restraining salt (ie. sodium sulfate) at a concentration of at least 3% by weight for a time sufficient (typically 10 to 120 hours) to form a reacted slurry. The slurry is heated at a temperature of at least 45C for a time sufficient (typically at least 30 minutes) to produce a gelatin containing solution. The gelatin containing solution is clarified by raising the pH of the solution to greater than 9.8. A sulfate salt of a divalent or trivalent metal is added to the gelatin solution to reduce the pH to between 7.0 and 8.0. An acid, preferably phosphoric, is added to the solution to reduce the pH to between 5.0 and 6.0. A polymeric flocculant is added to the gelatin containing solution at a weight percent of 0.1 based on the dry weight of the gelatin to form a floc which is removed. Following extraction and clarification the gelatin solution is filtered, oxidized or deionized to achieve desired levels of microconstituents, prior to concentration and drying. The rate of reaction with the collagen is a function of caustic concentration, salt concentration, temperature and time. The process is further specifically illustrated by Example 1 of U.S. Pat. No. 5,908,921.

Typical collagen containing materials include skins, bones and bides (i.e., any connective tissue of an animal body). Sources of animal bodies include cattle, pigs and sheep. Cattle bone is preferred, although other sources of bone can be effectively utilized in the present invention. A continuous process for leaching cattle bone is described in U.S. Pat. No. 4,824,939, incorporated herein by reference. In this process the bovine bone is placed into contact with an acid, typically hydrochloric acid. The acid reacts with the minerals contained in the bone to form soluble products, such as calcium chloride and phosphoric acid. These products are leached out of the bone and removed, typically as calcium hydrogen phosphate dihydrate. The demineralized bone or ossein is one source of collagen from which gelatin can be extracted.

A gelatin prepared by hydrolysis of ossein using sodium or potassium hydroxide as described above and which is employed in the elements of the invention is hereafter referred to as a "solubilized collagen" gelatin, as collagen from the source material is completely solubilized. Gelatin obtained therefrom is dissolved in a single extraction, and the described process advantageously creates a very uniform gelatin with minimal time and energy. The extracted gelatin may be purified through the use of a clarification process and desalted, typically using ultrafiltration or electrodialysis technology. Although the molecular weight of the gelatin obtained may be relatively high (such as obtained in U.S. Pat. No. 5,908,921 Example 1), the proteolytic degradation of gelatin (such as disclosed, e.g., in U.S. Pat. Nos. 5,919,906, 6,080,843, and 6,100,381) can be advantageously used to reduce the molecular weight to a desired range. The characteristics of the gelatin produced, using these methods is that it has a relatively high gel strength and narrow molecular weight distribution compared to gelatins produced by the conventional process where lime is used as the agent for hydrolysis. It has been surprisingly found that because of the narrow molecular weight distribution of the solubilized collagen gelatin, its use in imaging elements with a chemical crosslinker provides improved wet strength of the imaging elements (or decreased mushiness).

There are several classes of chemical crosslinkers/ hardeners that can be used for gelatin. These are described in, e.g., "The Theory of the Photographic Process" 4$^{th}$ Ed., Ed. T. H. James, pg. 77–87,1977. Hardeners can be either inorganic or organic in nature, and may be polymeric or non-polymeric. Typical inorganic hardening agents comprise multivalent cations, including salts of chromium and some salts of aluminum. These hardeners typically crosslink via the free carboxylic acids in gelatin and the degree of crosslinking is pH sensitive and also reversible. It is not preferable, however, to use these materials for absorbents because of the impact these materials have on the environment. The organic hardeners act via the ϵ-amino function of lysine and hydroxylysine. There are on the average of 350–400 $\mu$mole of lysine and about 20% of that amount of hydroxylysine per gram of dry gelatin. Classes of organic hardeners include, but are not limited to, aldehydes and blocked aldehydes, ketones, carboxylic and carbamic acid derivatives, active olefins, s-triazines, epoxides, aziridines, isocyanates, carbodiimides and isoxazolium salts, pyridinium ethers, carbamoyl- and carbamoyloxy-pyridinium ions, and sulfone based hardeners such as sulfonate esters and sulfonyl halides. Polymeric hardeners are generic polymer molecules bearing one or more of the above moieties in their chain.

In particular, the use of vinyl sulfone hardeners such as 1,2-bis(vinyl-sulfonyl)methane, 1,2-bis(vinyl-sulfonyl) methane ether, and 1,2-bis(vinyl-sulfonyl acetoamido) ethane, and other hardeners such as 2,4-dichloro-6-hydroxy-s-triazine, triacryloyl-triazine, and pyridinium, 1-(4-morpholinylcarbonyl)4-(2-sulfoethyl)-, inner salt are particularly useful. Also useful are so-called fast acting hardeners as disclosed in U.S. Pat. Nos. 4,418,142; 4,618,573; 4,673,632; 4,863,841; 4,877,724; 5,009,990; 5,236,822. The selection of the hardener type most useful for a particular application depends on the efficacy of the crosslinking, its toxicity in the native state and the residuals in the absorbent, and cost.

In preferred embodiments of the invention, the hardener is a vinyl-sulfone hardener. Vinyl-sulfone hardeners are well known. Typical vinyl-sulfone hardeners are described in U.S. Pat. Nos. 3,490,911, 3,539,644, 3,642,486, 3,841,872, 4,670,377, 4,897,344, 4,975,360 and 5,071,736, the entire disclosures of which are incorporated herein by reference. Preferred vinyl-sulfone hardeners for use in the present invention are represented by Formula (C) indicated below:

$$X^1—SO_2—L^1—SO_2—X^2 \quad (C)$$

wherein $X^1$ and $X^2$ represent $—CH{=}CH_2$ or $—CH_2CH_2—Y^1$ groups, and $X^1$ and $X^2$ may be the same or different; $Y^1$ represents a group which can be substituted by a nucleophilic reagent having a nucleophilic group, or a group which can be eliminated in the form of $HY^1$ by means of a base, and $L^1$ is a divalent linking group which may be substituted.

Preferred examples of the groups $X^1$ and $X^2$ are indicated below:

$—CH{=}CH_2$, $—CH_2CH_2—Cl$, $—CH_2CH_2—Br$, $—CH_2CH_2—OSO_2CH_3$, $—CH_2CH_2—OSO_2C_6H_5$, $—CH_2CH_2—OSO_2C_6H_4—CH_3$, $—CH_2CH_2—OSO_3Na$, $—CH_2CH_2—OSO_3K$, $—CH_2CH_2—OCOCH_3$, $—CH_2CH_2—OCOCF_3$, $—CH_2CH_2—OCOCHCl_2$, $—CH_2CH_2—N^+—C_6H_5(Cl^-)$, $—CH_2CH_2—N^+—C_6H_4$-p-$CH_2CH_2SO_3^-$, $—CH_2CH_2—N^+—C_6H_4$-m-$NHCH_2SO_3^-$

The group $—CH{=}CH_2$ is the most desirable for $X^1$ and $X^2$.

The divalent linking group $L^1$ is a divalent group preferably having up to 30 carbon atoms, more preferably up to 10 carbon atoms, and comprising an alkylene group (including cycloalkylene groups), an arylene group (including heterocyclic aromatic groups such as 5- to 7-membered ring groups containing 1 to 3 hetero atoms (e.g., a divalent group derived from thiadiazole or pyridine)) or combinations of these groups with one or more units represented by —O—, $NR^2$—, —SO.sub.2—, —SO. sub.3—, —S—, —SO—, $—SO_2NR^2—$, —CO—, —COO—, $—CONR^2—$, $—NR^2COO—$ and $—NR^2CONR^2—$, where R represents hydrogen or an alkyl group having from 1 to 15 carbon atoms, an aryl group or an aralkyl group. The $R^2$ groups may be joined together to form ring structures when the linking group includes two or more units of $—NR^2—$, $—SO_2NR^2—$, $—CONR^2—$, $—NR^2COO—$ and $—NR^2CONR^2—$. Moreover, $L^1$ may also be substituted by, for example, hydroxyl groups, alkoxy groups, carbamoyl groups, sulfamoyl group, sulfo groups or salts thereof, carboxyl groups or salts thereof, halogen atoms, alkyl groups, aralkyl groups and aryl groups. Furthermore, the substituent groups may be further substituted with one or more groups represented by $X^3—SO_2—$, where $X^3$ has the same significance as $x^1$ and $X^2$ described above.

The groups indicated below are typical examples of the linking group $L^1$. In these examples, a–k are integers of from 1 to 6. Of these, e can also have a value of zero, but e is preferably 2 or 3. The values of a–k except e are preferably 1 or 2, and most desirably are 1. In these formulae, $R^2$ preferably represents a hydrogen atom, or an alkyl group having from 1 to 6 carbon atoms, and most desirably represents a hydrogen atom, a methyl group or an ethyl group.

$L^1$ is preferably: $—(CH_2)_a—$, $—(CH_2)_b—O—(CH_2)_c—$, $—(CH_2)_d—CONR^2—(CH_2)_e—NR^2CO—(CH_2)_f—$, $—(CH_2)_g—SO_2—(CH_2)_h—$,

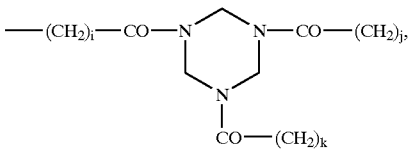

-continued

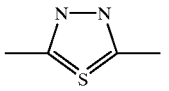

or

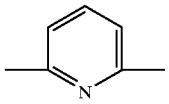

Typical nonlimiting examples of the film hardening agents for use in the present invention are indicated below.

H-1: $CH_2{=}CHSO_2CH_2SO_2CH{=}CH_2$

H-2: $CH_2{=}CHSO_2CH_2OCH_2SO_2CH{=}CH_2$

H-3: $CH_2{=}CHSO_2CH_2CH_2CH_2SO_2CH{=}CH_2$

H-4: $CH_2{=}CHSO_2CH_2CH(OH)CH_2SO_2CH{=}CH_2$

H-5: $CH_2{=}CHSO_2CH_2CONHCH_2CH_2NHCOCH_2SO_2CH{=}CH_2$

H-6: $CH_2{=}CHSO_2CH_2CONHCH_2CH_2CH_2NHCOCH_2SO_2CH{=}CH_2$

H-7:

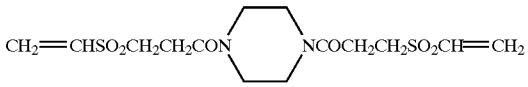

H-8:

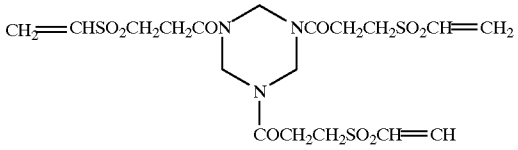

H-9:

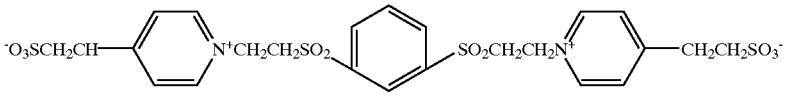

H-10:

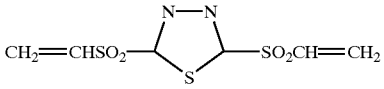

H-11: $(CH_2{=}CHSO_2CH_2)_3CCH_2SO_2CH_2CH_2NHCH_2CH_2SO_3Na$

H-12: $(CH_2{=}CHSO_2)_2CHCH_2CH_2{-}C_6H_4{-}SO_3Na$

In one embodiment of the invention, the hardener is preferably a non-polymeric bis(vinyl-sulfone), such as bis (vinyl-sulfonyl) methane (BVSM), bis(vinyl-sulfonyl methyl) ether (BVSME), or 1,2-bis(vinyl-sulfonyl acetoamide)ethane (BVSAE), etc. Non-polymeric vinyl-sulfone hardeners preferably have a molecular weight of less than 10,000, and more preferably of about 100 to about 5,000.

In other embodiments of the invention, a polymeric vinyl-sulfone hardener may be used, such as the polymeric hardeners disclosed in U.S. Pat. Nos. 4,161,407, 4,460,680 and 4,481,284, the entire disclosures of which are incorporated herein by reference. Preferred polymeric vinyl-sulfone hardeners are represented by Formula (D):

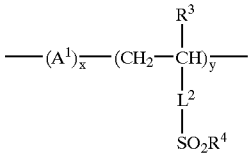

wherein $A^1$ is a monomer unit prepared by copolymerizing copolymerizable ethylenically unsaturated monomers, $R^3$ is hydrogen or a lower alkyl group having 1 to 6 carbon atoms; $L^2$ is a bivalent linking group, and $R^4$ is $-CH{=}CH_2$ or $-CH_2CH_2X^4$, where $X^4$ is a group capable of being substituted with a nucleophilic group or a group capable of being released in the form of $HX^4$ upon addition of a base, and x and y each represents molar percent, x being between 0 and 99 and y being between 1 and 100.

Examples of ethylenically unsaturated monomer represented by $A^1$ of Formula (D) include ethylene, propylene, 1-butene, isobuterie, styrene, chloromethylstyrene, hydroxymethylstyrene, sodium vinylbenzenesulfonate, sodium vinylbenzylsulfonate, N,N,N-trimethyl-N-vinylbenzylammonium chloride, N, N-dimethyl-N-benzyl-N-vinylbenzylammonium chloride, a-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (e.g., vinyl acetate and allyl acetate), ethylenically unsaturated mono- or dicarboxylic acids and salts thereof (e.g., acrylic acid, methacrylic acid, itaconic acid, maleic acid, sodium acrylate, potassium acrylate and sodium methacrylate), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N diethyl-N-methyl-N-methacryloyloxy-ethyl ammonium-p-toluene sulfonate, dimethyl itaconate and monobenzyl maleate), and amides of ethylenically unsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine). $A^1$ further includes monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate).

Examples of $R^3$ of Formula (D) include methyl, ethyl, butyl, tert-butyl, isopropyl, n-hexyl and the like.

Examples of $R^4$ of Formula (D) include the following groups:

$—CH{=}CH_2$, $—CH_2CH_2Cl$, $—CH_2CH_2Br$, $—CH_2CH_2O_3SCH_3$, $—CH_2CH_2OH$, $—CH_2CH_2O_2CCH_3$, $—CH_2CH_2O_2CCF_3$, $—CH_2CH_2CH$, $—CH_2CH_2O_2CCH_3$, and $—CH_2CH_2O_2CCHCl_2$.

$L^2$ of formula (D) is a bivalent linking group. In one preferred embodiment, $L^2$ is an alkylene group, preferably containing about 1 to 6 carbon atoms, an arylene group, preferably containing about 6 to 12 carbon atoms, —COZ—, or $—COZR^5—$ where $R^5$ is an alkylene group, preferably containing about 1 to 6 carbon atoms, or an arylene group, preferably containing about 6 to 12 carbon atoms. Preferably $L^2$ is a phenylene group.

In another embodiment of the invention $L^2$ is preferably a linking group of the formula $—Q—L^3—$, wherein Q is $—CO_2—$ or $—C(R^6)ON—$, wherein $R^6$ is hydrogen, a lower alkyl group having 1–6 carbon atoms or an arylene group having 6 to 10 carbon atoms, $L^3$ is a divalent group having 3 to 15 carbon atoms and containing at least one linking group selected from the members consisting of $—CO_2—$ and $—C(R^7)ON—$ wherein $R^7$ is the same as $R^6$ above or a divalent group having 1 to 12 carbon atoms and containing at least one linking group selected from the members consisting of —O—, $—N(R^8)—$, —CO—, —SO—, $—SO_2—$, $—SO_3—$, $—SO_2N(R^8)—$, $—N(R^8)CON(R^8)—$, and $—N(R^8)CO_2—$, wherein $R^8$ is hydrogen or a lower alkyl group having 1–6 carbon atoms.

The molecular weight of polymeric hardeners is generally greater than 10,000, typically in the range of 10,000 to 1,000,000, and more typically 30,000 to 500,000.

Other hardeners which may be used in this invention include carbamoyl- and carbamoyloxy-pyridinium hardeners which are disclosed, for example, in U.S. Pat. Nos. 4,063,952, 4,119,464, 4,828,974 and 4,751,173, and Japanese Kokai No. 61/009,641, and pyridinium hardeners which are disclosed, for example, in U.S. Pat. Nos. 5,263,822 and 4,877,724, the entire disclosures of which are incorporated herein by reference.

In accordance with the invention, it has surprisingly been found that the improvement provided by solubilized collagen gelatin over conventional lime processed gelatin is particularly substantial over a narrow range in effective level of organic hardener chemical crosslinker used. The useful concentration range of crosslinker in which we see that the solubilized collagen gelatin provides a substantial improvement in wet mechanical strength is from 70–120 effective $\mu$mole (i.e., $7\times10^{-5}$ to $1.2\times10^{-4}$ effective mole) hardener per gram of gelatin. The preferred concentration range of hardener, for use with the solubilized collagen gelatin, is from 80–110 effective $\mu$mole/g of gelatin, and more preferably from 90–105 effective $\mu$mole/g of gelatin, where the relative improvement due to use of a solubilized collagen gelatin is the maximum. For purposes of this invention we define an "effective mole" of hardener as the number of hardener compound molecules required to provide reaction sites for two moles of reactive moieties of gelatin. Thus, for a simple difunctional organic hardener compound like formaldehyde an effective mole is equal to an actual mole of hardener compound. For a trifunctional hardener compound, an effective mole would comprise ⅔ of an actual mole of trifunctional hardener, whereas for a polymeric hardener the effective moles is calculated based on the average number of monomer units of the polymeric compound that provide the species groups which act as crosslinkers. Thus for the preferred concentration ranges of hardener given above, the number of effective moles of crosslinking species should be considered.

In any gelatin based system, for a given amount of crosslinker, the mushiness increases or the wet mechanical strength decreases when the volume fraction of the non-gelatin material increases. The non-gelatin material in a hydrophilic colloid layer of an imaging element can include photographically useful materials like coupler dispersions, silver halide grains, dye particles or other filler materials needed for other functions, like latexes, silica particles and matte beads. It is surprisingly found that within the preferred range of crosslinker/hardener mentioned above, solubilized collagen gelatin is particularly useful at improving the wet mechanical properties, over conventional gelatin when the volume fraction of non-gelatin material is high. Thus, it is particularly preferable to use the solubilized collagen gelatin in the entire imaging element or in specific layers in the imaging element when the volume fraction of the non-gelatin material exceeds 0.2 and most preferably when it exceeds 0.4.

In general the wet mechanical strength of gelatin containing imaging elements decreases when the molecular weight of the gelatin is lower. The molecular weight of gelatin can be characterized by the viscosity of a gelatin solution at a specified concentration. For the purposes of this invention, unless otherwise stated, the viscosity of a 6.16 wt % gelatin solution, measured at 40C, is quoted. Although it may be preferred to use relatively low molecular weight gelatins with a viscosity as low as 4 cp in manufacturing operations, as such gelatins may advantageously either afford lower viscosity for coating solutions or allow an increase in the concentration of the solutions, most gelatins conventionally employed for imaging elements such as photographic elements are in the viscosity range of 8–10 cp, to provide a balance between desired mechanical strength and manufacturing performance. In accordance with a preferred embodiment of the invention, it is accordingly particularly advantageous to use solubilized collagen gelatin which provides relatively improved mechanical strength in individual layers or entire imaging elements obtained from solutions needing a low molecular weight gelatin, instead of a conventional lime processed low viscosity gelatin. In this instance the preferred viscosity of the solubilized collagen gelatin is between 4 and 8 cp and most preferably between 4 and 6 cp.

Although, it may be desirable from a cost and performance standpoint to replace all the gelatin in an imaging element with solubilized collagen gelatin, even partial replacement of the gelatin in any or all the layers of an imaging elements provides an improvement in the wet mechanical properties proportional to the fraction of solubilized collagen gelatin present. Thus, while the present invention is broadly directed towards the use of solubilized collagen gelatin in an amount of at least 20% of the gelatin in at least one layer of the imaging layer, it is preferable to have at least 50% as the solubilized collagen gelatin and more preferable to have at least 80% of solubilized collagen gelatin as the gelatin in at least one layer, and more preferably in all hydrophilic colloid layers of the elements of the invention. The advantages of the invention are applicable to imaging elements prepared by multilayer slide bead coating processes such as described in U.S. Pat. No. 2,716,419 as well as by multilayer slide curtain coating processes such as described in U.S. Pat. No. 3,508,947.

In addition to providing relative improvements in the wet mechanical strength of an imaging element comprising gelatin as a binder, without needing to increase the amount of chemical crosslinker with respect to the total amount of gelatin, the use of solubilized collagen gelatin in coating solutions for layers of such elements has been found to enable manufacturing advantages. A further advantage to the use of solubilized collagen gelatin in aqueous coating fluids for layers of imaging elements is that for coating fluids comprising gelatin and gelatin hardener which have similar concentrations and viscosities, the time for formation of gel slugs to be formed in a hardener-bearing coating fluid may be significantly extended when a solubilized collagen gelatin is employed rather than a conventional lime processed gelatin. Coating fluids containing specified levels of solubilized collagen gelatin and gelatin hardener are described in commonly assigned, concurrently-filed, co-pending application U.S. Ser. No. 10/158,681 (Kodak Docket 83293AJA), the disclosure of which is incorporated herein by reference. A further advantage to the use of solubilized collagen gelatin is that such gelatin enables increasing the concentrations of a coating fluid containing gelatin and dispersed sub-micron colloidal materials, reducing the size of the sub-micron colloidal materials in such a coating fluid, and/or including higher molecular weight gelatin in such a coating fluid without detrimentally increasing the viscosity of such fluids. Alternatively the use of a solubilized collagen gelatin enables reducing the viscosity of an aqueous coating fluid containing gelatin and dispersed insoluble colloidal material, without needing to reduce the concentration of gelatin or colloidal materials, increase the size of the sub-micron colloidal materials, and/or reduce the molecular weight of the gelatin. Coating fluids containing specified levels of solubilized collagen gelatin and a colloidal dispersed material phase are described in commonly assigned, concurrently-filed, co-pending application U.S. Ser. No. 10/158,651 (Kodak Docket 83294AJA), the disclosure of which is incorporated herein by reference.

The imaging elements of this invention can be of many different types depending on the particular use for which they are intended. Details with respect to the composition and function of a wide variety of different imaging elements are provided in U.S. Pat. No. 5,300,676 and references described therein. Such elements include, for example, photographic, electrophotographic, electrostatographic, photothermographic, migration, electrothermographic, dielectric recording and thermal-dye-transfer imaging elements. Layers of imaging elements other than the image-forming layer are commonly referred to auxiliary layers. There are many different types of auxiliary layers such as, for example, subbing layers, backing layers, interlayers, overcoat layers, receiving layers, stripping layers, antistatic layers, transparent magnetic layers, and the like.

In a particularly preferred embodiment, the imaging elements of this invention are photographic elements, such as photographic films, photographic papers or photographic glass plates, in which the image-forming layer is a radiation-sensitive silver halide emulsion layer. The thickness of the support is not critical. Film support thickness of 2 to 10 mil (0.06 to 0.30 millimeters), and thicker paper supports, e.g., typically can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer. The emulsion layers typically comprise a film-forming hydrophilic colloid. The most commonly used of these is gelatin and a solubilized collagen gelatin as described above is a particularly preferred material for use in photographic emulsions layers in such embodiments of invention.

Photographic imaging elements in accordance with specific embodiments of the present invention can be black and white, single color or multicolor photographic elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired. Dye-image-providing materials employed with conventional color photographic materials designed for processing with a separate developing solution are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

A typical multicolor photographic element comprises a support bearing a cyan dye image-forming unit comprised of at least one red- sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements may also usefully include a magnetic recording material as described in Research Disclosure, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical. The present invention also contemplates the use of photographic imaging elements in accordance with of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to Research Disclosure, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

Silver halide emulsions which may be employed in photographic imaging elements may be negative working, such as surface sensitive emulsions or unfogged internal latent image forming emulsions, or positive working emulsions of internal latent image forming emulsions (that are either fogged in the element or fogged during processing). With negative working silver halide a negative image can be formed, optionally, a positive (or reversal) image can be formed although a negative image is typically first formed in the reversal process. Suitable emulsions and their preparation as well as methods of chemical and spectral sensitization are described in Sections I through V. Color materials and development modifiers are described in Sections V through XX. Vehicles (which can be used in combination with solubilized collagen gelatin in photographic imaging elements in accordance with the invention) are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

Photographic imaging elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

Photographic imaging elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

Imaging elements may also contain other filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil in water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

Photographic imaging elements may further contain other image-modifying compounds such as "Developer Inhibitor-Releasing" compounds (DIR's). Useful additional DIR's for elements of the present invention, are known in the art and examples are described in U.S. Pat. Nos. 3,137, 578; 3,148, 022; 3,148,062; 3,227,554; 3,384,657; 3,379,529; 3,615, 506; 3,617,291; 3,620,746; 3,701,783; 3,733,201; 4,049, 455; 4,095,984; 4,126,459; 4,149,886; 4,150,228; 4,211, 562; 4,248,962; 4,259,437; 4,362,878; 4,409,323; 4,477, 563; 4,782,012; 4,962,018; 4,500,634; 4,579,816; 4,607, 004; 4,618,571; 4,678,739; 4,746,600; 4,746,601; 4,791, 049; 4,857,447; 4,865,959; 4,880,342; 4,886,736; 4,937, 179; 4,946,767; 4,948,716; 4,952,485; 4,956,269; 4,959, 299; 4,966,835; 4,985,336 as well as in patent publications GB 1,560,240; GB 2,007,662; GB 2,032,914; GB 2,099, 167;9 DE 2,842,063, DE 2,937,127; DE 3,636,824;, DE 3,644,416 as well as the following European Patent Publications: 272,573; 335,319; 336,411; 346, 899; 362, 870; 365,252; 365,346; 373,382; 376,212; 377,463; 378,236; 384, 670; 396,486; 401,612; 401,613. DIR compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference.

It is also contemplated that the present invention may be employed to obtain reflection color prints as described in Research Disclosure, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4, 994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077, 822; 90-078,229; 90-078,230; 90-079,336; 90-079,338; 90-079,690; 90-079,691; 90-080,487; 90-080,489; 90-080, 490; 90-080,491; 90-080,492; 90-080,494; 90-085,928; 90-086,669; 90-086,670; 90-087,361; 90-087,362; 90-087, 363; 90-087,364; 90-088,096; 90-088,097; 90-093,662; 90-093,663; 90-093,664; 90-093,665; 90-093,666; 90-093, 668; 90-094,055; 90-094,056; 90-101,937; 90-103,409; 90-151,577.

Silver halide used in photographic imaging elements may be silver iodobromide, silver bromide, silver chloride, silver chlorobromide, silver chloroiodobromide, and the like. For example, in one particular embodiment, the silver halide used in photographic imaging elements of the present invention may contain at least 90 mole% silver chloride or more (for example, at least 95%, 98%, 99% or 100% silver chloride). The type of silver halide grains preferably include polymorphic, cubic, and octahedral. The grain size of the silver halide may have any distribution known to be useful in photographic compositions, and may be either polydipersed or monodispersed.

Tabular grain silver halide emulsions may also be used. Tabular grains are those with two parallel major faces each clearly larger than any remaining grain face (e.g., ECD/t is at least 2, where ECD is the diameter of a circle having an area equal to grain projected area and t is tabular grain thickness), and tabular grain emulsions are those in which the tabular grains account for at least 50 percent, preferably at least 70 percent and optimally at least 90 percent of total grain projected area. The tabular grains can account for substantially all (e.g., greater than 97 percent) of total grain projected area. The tabular grain emulsions can be high aspect ratio tabular grain emulsions—i.e., ECD/t>8; intermediate aspect ratio tabular grain emulsions—i.e., ECD/t=5 to 8; or low aspect ratio tabular grain emulsions—i.e., ECD/t=2 to 5. The emulsions preferably typically 1exhibit high tabularity (T), where T (i.e., $ECD/t^2$)>25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated. Tabular grains formed of silver halide(s) that form a face centered cubic (rock salt type) crystal lattice structure can have either {100} or {111} major faces.

Silver halide grains may be prepared according to methods known in the art, such as those described in Research Disclosure I and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Silver halide grains may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in Research Disclosure I and the references cited therein.

Photographic imaging elements provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in Research Disclosure I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in Research Disclosure I. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof Chemical sensitization is generally carried out at pAg levels of from 5 to 10, pH levels of from 5 to 8, and temperatures of from 30 to 80C., as described in Research Disclosure I, Section IV (pages 510–511) and the references cited therein.

The silver halide may be sensitized by sensitizing dyes by any method known in the art, such as described in Research Disclosure I. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic imaging elements are preferably imagewise exposed using any of the known techniques, including those described in Research Disclosure I, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic imaging elements can be processed in any of a number of well-known photographic processes utilizing any of a number of well-known processing compositions, described, for example, in Research Disclosure I, or in T. H. James, editor, The Theory of the Photographic Process, 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are: 4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N4b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid. Development is followed by bleach-fixing, to remove silver or silver halide, washing and drying.

In a particular embodiment of the invention, solubilized collagen gelatin may be used in a photographic element which comprises a processing-solution-permeable overcoat that becomes water resistant in the photochemically processed product so as to resist fingerprints, common stains, and spills. Such overcoat formulation may comprise at least one water-dispersible hydrophobic polymer (e.g., a polyurethane-acrylic copolymer) interspersed with a water-soluble polymer (e.g., poly(vinyl alcohol)), such as described in copending, commonly assigned U.S. Ser. No. 09/621,267 filed Jul. 21, 2000, the disclosure of which is incorporated by reference herein. During development or thereafter, before drying, the water-soluble polymer in such compositions is removed to a significant extent, facilitating coalescence of the residual water-dispersible polymer, thereby forming a water-resistant continuous protective overcoat. The use of solubilized collagen gelatin in a layer coated under such an overcoat, e.g., in a UV layer, has been found to advantageously improve the resulting water resistant properties of the processed element relative to the use of a conventional gelatin in the layer coated under such an overcoat.

The following procedures were used to evaluate hydrophilic colloid compositions, as described in the examples set forth below.

EXAMPLE 1

Preparation of Gelatins

Two sets of gelatins were prepared for evaluating the physical properties of coatings. One set was prepared from a parent solubilized collagen gelatin A that was obtained using the process described in U.S. Pat. No. 5,908,921. The second set was prepared from a parent gelatin B that was obtained from a lime hydrolyzed ossein. Both parent gelatins were desalted using ion exchange resins and then their pH was adjusted to between 5.5 and 5.8 using sodium hydroxide. The following properties were measured in order to characterize the gelatins.

1Viscosity—It is the viscosity of a 6.16% gelatin solution measured at 40C using a capillary viscometer 2) Gel strength or bloom—the weight in gms required to depress a plunger of 0.5 inch in diameter, with a $1/64^{th}$ inch radius of curvature at the bottom, by 4 mm.

3)Molecular weight distribution—Using size exclusion chromatrography with a TOSO Haas gel size exclusion column with a UV detector. The weight average molecular weight was calculated from this measurement.

Each parent gelatin was further hydrolyzed in order to prepare the two series of gelatins. In each case, the method of hydrolysis employed was by enzymes. The specific enzyme used was a protease (Neutrase, manufactured by Novo Nordisk). The procedure used is as follows: A 20% solution of the parent gelatin is prepared at 50C. 10 ppm of the Neutrase was added and the viscosity of the gelatin solution was monitored. When the desired viscosity was reached the solution temperature was raised to 80C and held for 10 minutes to deactivate the enzyme. The gelatins obtained were characterized using the above methods and their properties are shown in table 1.

TABLE 1

| Gelatin | Parent gelatin | Viscosity (cP) | Gel strength | Mw |
|---|---|---|---|---|
| A | — | 8.94 | 338 | 150,253 |
| A1 | A | 7.1 | 334 | 134,555 |
| A2 | A | 5.26 | 335 | 101,467 |
| A3 | A | 3.96 | 265 | 65,460 |
| A4 | A | 3.21 | 213 | 55,976 |
| A5 | A | 2.81 | 117 | 45,778 |
| B | — | 12.83 | 213 | 207,041 |
| B1 | B | 7.21 | 220 | 167,014 |
| B2 | B | 6.16 | 219 | 150,439 |
| B3 | B | 5.31 | 216 | 132,835 |
| B4 | B | 4.66 | 205 | 116,980 |
| B5 | B | 3.96 | 195 | 100,178 |
| B6 | B | 3.16 | 147 | 72,959 |

Preparation of Dispersions

Each of the gelatins was used to prepare an oil in water dispersion, using di-undecyl phthalate as the oil phase, prepared using a high pressure homogenizer. Each dispersion comprised 8 wt % oil, 8 wt % gelatin and 0.8 wt % Alkanol-XC (a surfactant). The drop size of each dispersion was characterized by light scattering, and the average drop size of each dispersion was similar (ranging from 0.15 to 0.2 $\mu$m).

Coating Preparation

Single-layer "unfilled" gelatin layer coatings (no dispersed phase) were made onto 180 micrometer (7 mil) thick bi-axially oriented polyethylene teraphthalate film support that had been subbed with a terpolymer latex of acrylonitrile, vinylidene chloride, and acrylic acid. The aqueous coating formulations comprised 5.88 wt % gelatin of interest, 0.059 wt % Olin 10G (surfactant) and 0.106 wt % bis(vinyl sulfone) methane (BVSM) hardener, and were coated at 183 g/m$^2$ (17 g/ft$^2$) and dried to give coatings of 10.8 g/m$^2$ (1000 mg/ft$^2$) gelatin with 0.108 g/m$^2$ (10 mg/ft$^2$) of Olin 10G and 0.194 g/m$^2$ (18 mg/ft$^2$) of BVSM. This corresponds to a hardener level of 92 $\mu$mole/g of gelatin.

Single-layer "filled" coatings having a volume fraction of non-gelatin material of approximately 0.57 were prepared identical to the unfilled coatings, except the coating formulations additionally comprised 5.88 wt % of di-undecyl phthalate, where a dispersion prepared as described above was used as the source of gelatin and di-undecyl phthalate. The addition of di-undecyl phthalate in a gelatin coating simulates an actual photographic coating containing a photographically useful compound (e.g., imaging couplers) and high-boiling organic solvents. The formulations were coated at 183 g/m$^2$ (17 g/ft$^2$) and dried to give coatings of 10.8 g/m$^2$ (1000 mg/ft$^2$) gelatin and 10.8 g/m$^2$ (1000 mg/ft$^2$) di-undecyl phthalate, with 0.108 g/m$^2$ (10 mg/ft$^2$) of Olin 10G, and 0.194 g/m$^2$ (18 mg/ft$^2$) of BVSM. This corresponds to a hardener level of 92 $\mu$mole/gm of gelatin.

Coatings were incubated in a condition of 21C (70F) and 50% RH for 22 days before testing.

Evaluation of Physical Properties of Coatings

A Wet Emulsion Scratch Test was performed on coatings that had been submerged in Kodak T-213 developer as a swelling agent at 40C for 3 minutes. A spherical-jewel stylus of 8 mils in radius was dragged across the swollen sample while the normal load linearly increases with the distance dragged. At some distance along the sample, a scratch will form. The point where the scratch forms when observed by the naked eye is taken as the wet scratch resistance or the "grams to plow". A higher value of "grams to plow" demonstrates that the gelatin coating is more resistant to wet scratch. An average from 5 repeats was reported for each sample.

Gravimetric swell is defined as the weight increase per square foot of a coating as it was fully swollen in a liquid of choice. The experiment was carried out by soaking of 3 inch×3 inch square sample of a coating in Kodak T-213 developer for 3 minutes at 40C, with the weight of the coating before and after swelling being measured. The increase in weight is the liquid absorbed by the gelatin coating and is reported in grams/ft$^2$.

Tables 2 and 3 show the gravimetric swell data and the wet scratch results for "unfilled" and "filled" coatings, respectively.

TABLE 2

| Coatings with 10.8 g/m$^2$ (1000 mg/ft$^2$) of gelatin | | |
|---|---|---|
| Gel type | Gravimetric swell (g/ft2) | Wet scratch resistance (g to form a scratch) |
| A1 | 3.45 | 39 |
| A2 | 3.22 | 30 |
| A3 | 3.41 | 29 |
| A4 | 3.41 | 26 |
| A5 | 3.56 | 22 |
| B1 | 3.73 | 23 |
| B2 | 4.32 | 16 |
| B3 | 4.08 | 14 |
| B4 | 4.06 | 17 |
| B5 | 4.37 | 13 |
| B6 | 4.91 | 5 |

TABLE 3

| Coatings with 10.8 g/m$^2$ (1000 mg/ft$^2$) gelatin and 10.8 g/m$^2$ (1000 mg/ft$^2$) diundecyl phthalate | | |
|---|---|---|
| Gel type | Gravimetric Swell (g/ft2) | Wet scratch resistance (g to form a scratch) |
| A1 | 4.34 | 16 |
| A2 | 4.02 | 18 |
| A3 | 4.40 | 12 |
| A4 | 4.54 | 11 |
| A5 | 4.42 | 10 |
| B1 | 5.61 | 6 |
| B2 | 5.55 | 5 |
| B3 | 5.18 | 5 |
| B4 | 5.65 | 4 |
| B5 | 5.96 | 2 |
| B6 | 6.70 | 0 |

Tables 2 and 3 show that for both coating formats, the solubilized collagen gelatin such as that produced by the method described in U.S. Pat. No. 5,908,921 performs superior to the coatings made with gelatins manufactured by the conventional lime process, when crosslinked with hardened in accordance with the invention. The strength of the coatings in the wet state are higher with the former gelatin and the amount of swell is also lower. The decrease in swell is beneficial because it potentially reduces the load of the drying after photoprocessing.

It is also seen that for gelatins having a viscosity less than 6 cp, the wet scratch resistance numbers using conventional gelatins is quite low, while for solubilized collagen gelatin of similar viscosity, the wet scratch resistance numbers are substantially higher. This would facilitate the reduction in viscosity of the coating solutions without detrimentally impacting wet scratch resistance.

EXAMPLE 2

A conventionally prepared gelatin (gel B7) and a solubilized collagen gelatin prepared by a process as described in U.S. Pat. No. 5,908,921 (gel A6) were used to prepare coatings for this example. The properties of the gelatins are as listed below:

| | Gel A6 | Gel B7 |
|---|---|---|
| Viscosity of 6.16% solution (cp) | 5.1 | 4.9 |
| Gel strength (g) | 328 | 256 |

Di-undecyl phthalate solvent dispersions were made with each of the two gelatins, and single layer coatings were prepared as described in Example 1. Each gelatin was coated at a level of 10.8 g/m$^2$ (1000 mg/ft$^2$) and varying levels of solvent drops (0, 2.7, 5.4 and 10.8 g/m$^2$) to provide solvent volume fractions of 0, 0.25, 0.4 and 0.57 in the coated layers. At each level of solvent, there were three levels of BVSM hardener coated (1.2 wt %, 1.8 wt % and 2.4 wt % with respect to the amount of gelatin), which corresponds to 61.2, 92 and 122 $\mu$mole/g gelatin.

The coatings were incubated and tested for wet scratch resistance, as described in Example 1. Table 4 shows the results obtained. The last column shows the improvement in wet scratch resistance obtained between coatings made with gel A6 and with gel B7.

TABLE 4

| Volume fraction | BVSM level $\mu$mole/g | Wet scratch resistance (g to form a scratch) | | |
|---|---|---|---|---|
| solvent | gelatin | gel B7 | gel A6 | Improvement |
| 0 | 61.2 | 25.7086 | 32.5984 | 6.89 |
| 0.25 | 61.2 | 22.7165 | 21.5748 | −1.14 |
| 0.4 | 61.2 | 16.1023 | 22.0866 | 5.984 |
| 0.57 | 61.2 | 9.0551 | 14.9212 | 5.866 |
| 0 | 92 | 44.5668 | 48.8976 | 4.331 |
| 0.25 | 92 | 35.1574 | 42.8739 | 7.717 |
| 0.4 | 92 | 28.6614 | 38.0314 | 9.37 |
| 0.57 | 92 | 17.6378 | 34.9606 | 17.32 |
| 0 | 122 | 56.2204 | 52.0078 | −4.21 |
| 0.25 | 122 | 49.4094 | 49.0157 | −0.39 |
| 0.4 | 122 | 37.5196 | 44.6456 | 7.126 |
| 0.57 | 122 | 22.559 | 30.748 | 8.189 |

As seen from the data, coatings made with solubilized collagen gelatin A6 gives a higher wet strength than coatings made with gelatin B7, even though each gelatin had similar viscosity of about 5 cp. The differences between the wet scratch resistance properties of the two gelatins is the highest at the effective hardener level of 92 $\mu$mole BVSM /g gelatin. At the higher and lower hardener level, while the coatings made with gelatin A6 generally have a higher wet strength than coatings made with gelatin B7, the differences between the two are smaller than at the intermediate hardener level. Thus, it is observed that the degree in improvement in wet scratch resistance depends on the amount of hardener employed.

At all three hardener levels we see that the differences between the wet scratch resistance properties of the two gelatins is higher at the higher volume fraction of filler material. Thus, the use of solubilized collagen gelatin in imaging elements would be particularly useful for elements or layers (in a multilayer element) that have high level of filler material.

EXAMPLE 3

A color-negative imaging element on reflective support was prepared using primarily conventionally prepared lime-processed gelatin in the hydrophilic colloid layers thereof In the coating structure, a blue imaging layer comprising a yellow coupler mixed with a blue-sensitive chloro-iodide cubic emulsion (0.2 mole % iodide, 0.6 μm cubic edge length average grain size) was the first layer of a three-color photographic recording material on a resin-coated paper support. The subsequent layers comprised, in order, of a layer containing a scavenger for oxidized developer, a green imaging layer, a second scavenger layer, a red imaging layer, a uv absorbing layer and a protective gelatin super-coat. The green imaging layer comprised a dispersion of magenta coupler mixed with a green-sensitive chloride cubic emulsion (0.3 μm cubic edge length average grain size) while red-sensitized chloride emulsion (0.4 μm cubic edge length average grain size) was mixed with a dispersion of cyan couplers to form the red imaging layer. Details of the structure of the multilayer coating, including component coverages in each layer, are shown below. The hardener level in this experiment is 102 μmole BVSM/g of total gelatin.

| Coating structure | |
|---|---|
| Layer 7 (Supercoat) | |
| Ludox AM ® (DuPont) | 0.1614 $g \cdot m^{-2}$ |
| Gelatin (acid-processed) | 0.6456 $g \cdot m^{-2}$ |
| Layer 6 (UV Layer) | |
| Tinuvin-328 ® | 0.130 $g \cdot m^{-2}$ |
| Tinuvin 326 ® | 0.023 $g \cdot m^{-2}$ |
| DMBHQ | 0.042 $g \cdot m^{-2}$ |
| CS-3 | 0.051 $g \cdot m^{-2}$ |
| Gelatin | 0.525 $g \cdot m^{-2}$ |
| Layer 5 (Red-sensitive Layer) | |
| Ag | 0.198 $g \cdot m^{-2}$ |
| Coupler CC-1 | 0.232 $g \cdot m^{-2}$ |
| Coupler CC-2 | 0.026 $g \cdot m^{-2}$ |
| Tinuvin 328 ® | 0.355 $g \cdot m^{-2}$ |
| CS-3 | 0.145 $g \cdot m^{-2}$ |
| CS-4 | 0.436 $g \cdot m^{-2}$ |
| Gelatin | 1.312 $g \cdot m^{-2}$ |
| Layer 4 (Interlayer B) | |
| DMBHQ | 0.108 $g \cdot m^{-2}$ |
| CS-2 | 0.197 $g \cdot m^{-2}$ |
| Gelatin | 0.753 $g \cdot m^{-2}$ |
| Layer 3 (Green-sensitive Layer) | |
| Ag | 0.099 $g \cdot m^{-2}$ |
| Coupler MC-1 | 0.208 $g \cdot m^{-2}$ |
| St-4 | 0.040 $g \cdot m^{-2}$ |
| St-3 | 0.274 $g \cdot m^{-2}$ |
| CS-5 | 0.218 $g \cdot m^{-2}$ |
| CS-2 | 0.112 $g \cdot m^{-2}$ |
| Gelatin | 1.187 $g \cdot m^{-2}$ |
| Layer 2 (Interlayer A) | |
| DMBHQ | 0.108 $g \cdot m^{-2}$ |
| CS-2 | 0.197 $g \cdot m^{-2}$ |
| Gelatin | 0.753 $g \cdot m^{-2}$ |

-continued

| Layer 1 (Blue-sensitive Layer) | |
|---|---|
| Ag | 0.217 $g \cdot m^{-2}$ |
| Coupler YC-1 | 0.414 $g \cdot m^{-2}$ |
| St-1 | 0.173 $g \cdot m^{-2}$ |
| St-2 | 0.025 $g \cdot m^{-2}$ |
| St-4 | 0.099 $g \cdot m^{-2}$ |
| CS-1 | 0.218 $g \cdot m^{-2}$ |
| HQ-K | 0.0095 $g \cdot m^{-2}$ |
| PHR | 0.0011 $g \cdot m^{-2}$ |
| Gelatin | 1.244 $g \cdot m^{-2}$ |
| Hardener | 0.125 $g \cdot m^{-2}$ |
| Support | |

PHR = 2,5-dihydroxy-5-methyl-3-(1-piperidenyl)-2-cyclopenten-1-one
HQ-K = 2,5-dihydroxy-4-(1-methylheptadecyl)-benzenesulphonic acid (K salt)
DMBHQ = 2,5-di-(1,1,3,3-tetramethylbutyl)hydroquinone
Hardener = bis(vinylsulphonyl)methane (BVSM)

Stabilizer St-1

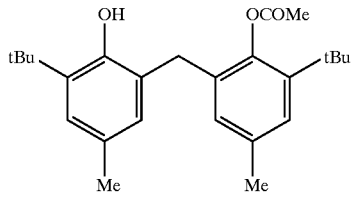

Stabilizer St-2

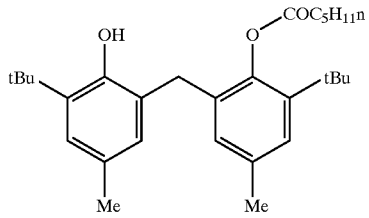

Stabilizer St-3

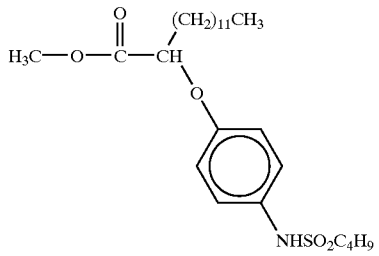

Stabilizer St-4

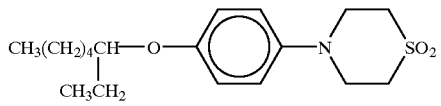

Solvent CS-1

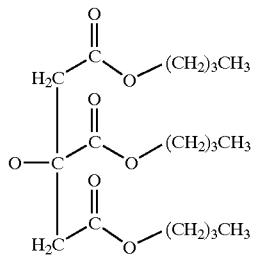

-continued

Solvent CS-2

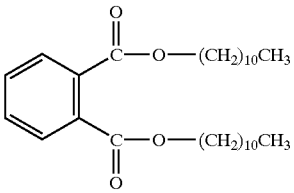

Solvent CS-3

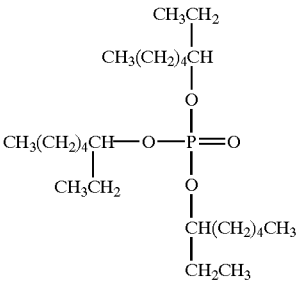

Solvent CS-4

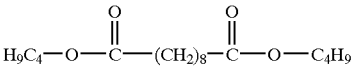

Solvent CS-5

$CH_3(CH_2)_7CH{=}CH(CH_2)_8{-}OH$

Coupler YC-1

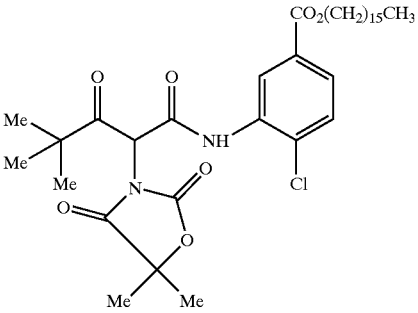

Coupler MC-1

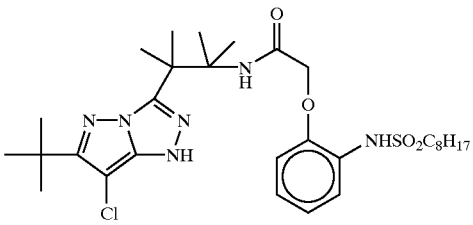

Coupler CC-1

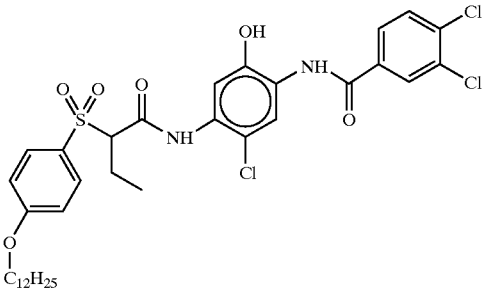

-continued

Coupler CC-2

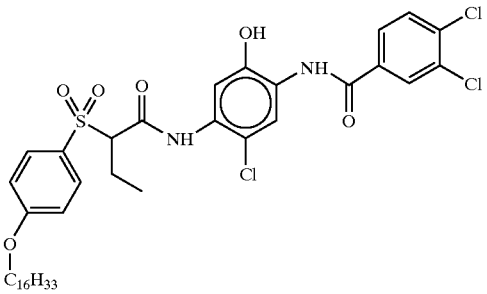

In a second element, all of the gelatins employed which were prepared conventionally by the lime hydrolysis of ossein were replaced by a solubilized collagen gelatin having a gelatin viscosity of 6.3 cP, which was prepared by the sodium hydroxide hydrolysis of ossein, except for and the gelatin that is used to make the silver halide emulsions in layers 1, 3, and 5. Also, acid-processed gelatin employed in the overcoat (layer 7) was not replaced. The majority of the replaced gelatin in each layer had a gelatin viscosity of at least 8 cp and a minor amount had a gelatin viscosity of 5 cp. The average gelatin viscosity of the replaced gelatin in each layer was thus greater than the gelatin viscosity of the solubilized collagen gelatin. The percent gelatin replacement for each layer was as follows:

| Layer | % Replacement of Lime-Processed Gelatin with Solubilized Collagen Gelatin in each layer |
|---|---|
| 7 | 0 |
| 6 | 100% |
| 5 | 87% |
| 4 | 100% |
| 3 | 90% |
| 2 | 100% |
| 1 | 82% |

The incubated hardened coatings were tested for wet scratch resistance as described in Example 1 at different times of incubation after coating, and the results are reported in Table 5 below.

TABLE 5

| | Wet scratch resistance (g to form a scratch) | | |
|---|---|---|---|
| Gelatin type | 3 day incubation | 14 day incubation | 28 day incubation |
| Solubilized Collagen | 14 | 23 | 32 |
| Lime-Processed | 10 | 19 | 24 |

As the data shows, the element employing a solubilized collagen gelatin made by sodium hydroxide hydrolysis has a higher wet strength at all incubation times.

EXAMPLE 4

Color-negative film elements 601–604 are prepared as described for the multilayer photographic film in Example 5 of U.S. Pat. No. 6,316,174, the disclosure of which is incorporated by reference, except that various weight percentages of the gelatin employed in each layer thereof is comprised of a solubilized collagen gelatin in accordance with the invention as indicated in Table 6 below. BVSM hardener is present in each element at a level of 95 μmole hardener per gram of total gelatin. Where the solubilized collagen prepared gelatin is present in a layer at less than 100% used in combination with lime-processed gelatins, the solubilized collagen is preferentially used in the preparation of colloidal dispersions of photographically useful compounds contained in such layer, and in the coating solutions containing these dispersions where additional gelatin is required. Further replacement of lime-processed gelatins in emulsion layers is accomplished by replacing gelatins used to dilute the light-sensitive silver halide emulsions, and lastly the gelatin of the invention may be used to precipitate and sensitize the emulsions. The lime-processed gelatin has a viscosity of 8.5 cP at 6.16% gelatin. The solubilized collagen prepared gelatin has a viscosity of 6.0 cP.

TABLE 6

Percentage of lime-processed gelatin replaced by solubilized collagen

| | Solubilized collagen gelatin % | | | |
|---|---|---|---|---|
| Layer | Element 601 | Element 602 | Element 603 | Element 604 |
| 1 (Antihalation layer) | 50% | 50% | 80% | 100% |
| 2 (Slow red-sensitive layer) | 50% | 50% | 80% | 100% |
| 3 (Mid red-sensitive layer) | 50% | 50% | 80% | 100% |
| 4 (Fast red-sensitive layer) | 50% | 50% | 80% | 100% |
| 5 (Interlayer) | 50% | 75% | 100% | 100% |
| 6 (Slow green-sensitive layer) | 50% | 50% | 80% | 100% |
| 7 (Mid green-sensitive layer) | 50% | 50% | 80% | 100% |
| 8 (Fast green-sensitive layer) | 50% | 50% | 80% | 100% |
| 9 (Yellow filter layer) | 50% | 75% | 100% | 100% |
| 10 (Slow blue-sensitive layer) | 50% | 50% | 80% | 100% |
| 11 (Fast blue-sensitive layer) | 50% | 50% | 80% | 100% |
| 12 (UV layer) | 50% | 75% | 100% | 100% |
| 13 (Overcoat layer) | 50% | 75% | 100% | 100% |

EXAMPLE 5

A photographic element is prepared as in Example 3 employing 100% solubilized collagen gelatin in the UV Layer (Layer 6), with the Supercoat (Layer 7) being replaced with an overcoat comprising 175 mg/sq.ft of a polyurethane-acrylic copolymer, 61 poly(vinyl alcohol) (PVA), and 1.75 CX-100® (polyfunctional aziridine crosslinker, obtained from Neo Resins, a division of Avecia). The polyurethane-acrylic copolymer is obtained as follows: Into a dry reactor charge 96 grams of a diol (Millester® 9-55, MW2000 from Polyurethane Corporation of America), 87 grams of the methylene bis(4-cyclohexyl) isocyanate (Desmodur®W) and 0.02 grams of dibutyltin dilaurate (Aldrich). The mixture is held with stirring for 90 minutes at 94° C. under a blanket of argon after which 14 grams of dimethylol propionic acid is added to the reactor and the mixture stirred for 1.5 hours at 94° C. At this point 24 grams of methyl methacrylate is added and stirred for 1 hour at the same temperature. The resultant prepolymer is cooled to below 40° C., dissolved in a vinyl monomer mixture consisting of 113 grams of n-butyl acrylate, 183 grams of methyl methacrylate, and 5 grams of acetoacetoxyetbyl methacrylate, and then treated with II grams of triethylamine and 2.5 grams of initiator (AIBN). To this mixture is added 1000 ml deoxygenated water followed by 10 grams of ethylene diamine in 20 grams of water. The dispersion is heated to 65° C., held there with stirring for 2 hours and heated further to 80° C. for 10 hours. The resulting dispersion of the urethane acrylic copolymer has an acid number of 11.

Upon standard photographic processing of the element, excellent water resistance of the overcoat is achieved, with improved performance relative to a similar photographic element prepared with 100% conventional lime processed gelatin in the UV layer.

The invention has been described in detail with particular reference to certain preferred embodiments thereof, but it will be understood that variations and modifications can be effected within the spirit and scope of the invention.

What is claimed is:

1. An imaging element comprising one or more hydrophilic colloid layers which include gelatin as a film forming binder which has been chemically crosslinked with a gelatin hardener, wherein at least 20% of the gelatin of at least one of the one or more hydrophilic colloid layers comprises a gelatin prepared from hydrolysis of ossein using sodium or potassium hydroxide, and the gelatin is chemical crosslinked with a gelatin hardener at a level from 70–120 effective μmole hardener per gram of gelatin.

2. An element according to claim 1, wherein the hardener level is from 80–110 effective μmole hardener per gram of gelatin.

3. An element according to claim 1, wherein the hardener level is from 90–105 effective μmole hardener per gram of gelatin.

4. An element according to claim 1, wherein at least 50% of the gelatin of at least one of the one or more hydrophilic colloid layers comprises a gelatin prepared from hydrolysis of ossein using sodium or potassium hydroxide.

5. An element according to claim 1, wherein at least 80% of the gelatin of at least one of the one or more hydrophilic colloid layers comprises a gelatin prepared from hydrolysis of ossein using sodium or potassium hydroxide.

6. An element according to claim 1, wherein the hardener is a vinyl sulfone hardener.

7. An element according to claim 6, wherein the vinyl sulfone hardener is bis(vinyl-sulfonyl) methane, bis(vinyl-sulfonyl methyl) ether, or 1,2-bis(vinyl-sulfonyl acetoamide)ethane.

8. An element according to claim 6, wherein the vinyl sulfone hardener is a polymeric vinyl sulfone.

9. An element according to claim 1, wherein the gelatin prepared from hydrolysis of ossein using sodium or potassium hydroxide is prepared by a process comprising:

providing a collagen containing material;

demineralizing the collagen containing material to produce ossein;

adding the ossein to a water solution containing at least 4% sodium hydroxide or potassium hydroxide and at least 3% sodium sulfate for a time sufficient to form a reacted slurry;

heating the slurry to at least 45 C for a time sufficient to produce a solution containing gelatin;

raising the pH of the gelatin solution to greater than 9.8;

adding a sulfate salt of a divalent or trivalent cation to the gelatin solution to reduce the pH to between 7.0 and 8.0;

adding an acid to the gelatin solution to reduce the pH to between 5.0 and 6.0;

adding a polymeric flocculant to the gelatin solution in an amount of about 0.1 percent based on a dry weight of the gelatin to produce a floc;

removing the floc from the gelatin solution;

filtering the gelatin solution; and desalting the gelatin solution.

10. An element according to claim 9, wherein the gelatin prepared from hydrolysis of ossein using sodium or potassium hydroxide has been further hydrolyzed in the presence of a protease enzyme to provide a gelatin with a viscosity of between 4 and 8 cp, where the viscosity is that of a 6.16 wt % gelatin solution, measured at 40C.

11. An element according to claim 10, where the viscosity of the gelatin is between 4 and 6 cp.

12. An element according to claim 1, wherein the gelatin prepared from hydrolysis of ossein using sodium or potassium hydroxide has been further hydrolyzed in the presence of a protease enzyme to provide a gelatin with a viscosity of between 4 and 8 cp, where the viscosity is that of a 6.16 wt % gelatin solution, measured at 40C.

13. An element according to claim 12, where the viscosity of the gelatin is between 4 and 6 cp.

14. An element according to claim 1, where the at least one of the one or more hydrophilic colloid layers comprises non-gelatin material in a volume fraction greater than 0.2.

15. An element according to claim 14, where the volume fraction is greater than 0.4.

16. An element according to claim 1 further comprising an overcoat layer comprised of at least one water-dispersible hydrophobic polymer interspersed with a water-soluble polymer, which overcoat layer is coated over at least one hydrophilic colloid layer of the element which includes gelatin as a film forming binder which is comprised of at least 20% of a gelatin prepared from hydrolysis of ossein using sodium or potassium hydroxide and which has been chemically crosslinked with a gelatin hardener, wherein upon contact with photographic processing solutions the water-soluble polymer in the overcoat layer is removed to a significant extent and the residual water-dispersible polymer coalesces to form a water-resistant protective overcoat.

* * * * *